US011286149B2

(12) United States Patent
Worthington

(10) Patent No.: US 11,286,149 B2
(45) Date of Patent: Mar. 29, 2022

(54) MOUTHWASH LIQUID DISPENSING SYSTEM

(71) Applicant: Colgate-Palmolive Company, New York, NY (US)

(72) Inventor: Brian Worthington, Dunellen, NJ (US)

(73) Assignee: Colgate-Palmolive Company, New York, NY (US)

( * ) Notice: Subject to any disclaimer, the term of this patent is extended or adjusted under 35 U.S.C. 154(b) by 208 days.

(21) Appl. No.: 16/647,664

(22) PCT Filed: Sep. 18, 2017

(86) PCT No.: PCT/US2017/052040
§ 371 (c)(1),
(2) Date: Mar. 16, 2020

(87) PCT Pub. No.: WO2019/055047
PCT Pub. Date: Mar. 21, 2019

(65) Prior Publication Data

US 2020/0262694 A1 Aug. 20, 2020

(51) Int. Cl.
*B67D 3/00* (2006.01)
*B67D 7/02* (2010.01)
(Continued)

(52) U.S. Cl.
CPC ..... *B67D 3/0032* (2013.01); *A47K 5/00* (2013.01); *A47K 5/18* (2013.01); *B67D 3/0045* (2013.01);
(Continued)

(58) Field of Classification Search
CPC ..... B67D 3/0032; B67D 7/0294; B67D 2210/00031; F16K 15/025–028; A47K 5/00
(Continued)

(56) References Cited

U.S. PATENT DOCUMENTS 3,081,004 A * 3/1963 Penn ..... A01D 43/14 222/161
3,123,107 A * 3/1964 Kappler ..... B65G 69/183 141/352
(Continued)

FOREIGN PATENT DOCUMENTS

CN 2619927 6/2004
CN 1699807 11/2005
(Continued)

OTHER PUBLICATIONS

International Search Report and Written Opinion of the International Searching Authority in International Application No. PCTUS2017052040, dated May 17, 2018.

*Primary Examiner* — Frederick C Nicolas
*Assistant Examiner* — Randall A Gruby

(57) ABSTRACT

A mouthwash dispensing system including: a bottle with a threaded neck (150) defining an opening (140) and configured to hold a liquid; a dispenser (340) including a receiving orifice (380) and a receiving protrusion (390); and a spring-actuated adapter, including: an adapter orifice (250); a valve stem (220, 260) including a spring (270) and a seal (280), wherein the spring (270) is configured to bias the seal (280) to move the spring-actuated adapter to a closed position; a threaded adapter (230) configured to couple the spring-actuated adapter to the threaded neck (150); and a friction-fit adapter configured to couple the spring-actuated adapter to the dispenser (340); wherein, when the spring-actuated adapter is coupled to the dispenser (340), the receiving protrusion (390) moves the spring-actuated adapter to an open position to allow the liquid to flow from the bottle through the adapter orifice (250) and into the dispenser (340).

15 Claims, 8 Drawing Sheets

(51) Int. Cl.
*B67D 7/36* (2010.01)
*A47K 5/18* (2006.01)
*A47K 5/00* (2006.01)

(52) U.S. Cl.
CPC ..... *B67D 7/0288* (2013.01); *B67D 7/36* (2013.01); *B67D 2210/00031* (2013.01)

(58) Field of Classification Search
USPC ..... 222/181.1–185.1, 207, 359, 514
See application file for complete search history.

(56) References Cited

U.S. PATENT DOCUMENTS 4,372,467 A * 2/1983 Pritchitt ..... G03G 15/104 222/501
4,660,746 A 4/1987 Wright
4,717,051 A 1/1988 Leclerc
4,802,513 A * 2/1989 Reynolds ..... B08B 9/0804 137/312
4,862,918 A * 9/1989 Schroeder ..... B67D 7/0294 137/614.19
4,972,976 A 11/1990 Romero
5,154,212 A * 10/1992 Weber ..... A47K 5/13 141/353
5,413,152 A * 5/1995 Burrows ..... B67D 3/0032 141/18
5,431,205 A * 7/1995 Gebhard ..... B67D 1/0835 141/286
5,556,005 A 9/1996 Banks
5,598,877 A * 2/1997 Reidel ..... A47K 5/13 141/346
5,713,492 A 2/1998 Degennaro
6,041,966 A * 3/2000 Piccinino, Jr. ..... B67D 1/1247 141/96
6,131,774 A * 10/2000 Thomas ..... G01F 11/282 222/181.2
6,923,345 B1 * 8/2005 Laible ..... B67D 7/0294 222/185.1
6,945,432 B2 * 9/2005 Laible ..... B67D 7/0294 222/185.1
6,945,433 B2 * 9/2005 Laible ..... B67D 7/0294 222/185.1
6,986,443 B2 1/2006 Laible
7,789,276 B2 * 9/2010 Delande ..... B65D 83/20 222/518
7,841,492 B2 * 11/2010 Laible ..... G01F 11/025 222/442
8,191,735 B2 * 6/2012 Laible ..... B67D 7/02 222/185.1
9,579,262 B2 2/2017 Crawford et al.
9,828,229 B2 11/2017 Yang et al.
11,124,338 B1 * 9/2021 Laible ..... B65D 47/30
11,125,347 B1 * 9/2021 Laible ..... B67D 3/0025
2007/0039980 A1 * 2/2007 Kjeldsen ..... B67D 7/005 222/514
2007/0295753 A1 * 12/2007 Vangeel ..... G01F 11/025 222/163
2008/0277001 A1 11/2008 Wheaton
2009/0159618 A1 * 6/2009 Laible ..... B67D 3/0041 222/442
2011/0030810 A1 * 2/2011 Shellcot ..... B67D 3/044 137/171
2014/0231462 A1 * 8/2014 Ray ..... A47K 5/122 222/207
2016/0375452 A1 * 12/2016 Skillin ..... B05B 11/0032 222/207

FOREIGN PATENT DOCUMENTS

CN 201806531 4/2011
CN 103654423 3/2014
CN 206621334 11/2017
GB 532530 1/1941
WO 2014/032208 3/2014

* cited by examiner

MOUTHWASH LIQUID DISPENSING SYSTEM

BACKGROUND

The use of an oral rinse or mouthwash has become an integral part of many people's daily oral hygiene routine.

Mouthwash is traditionally available to consumers in a variety of bottle sizes, which are used to pour the mouthwash into a dispensing cup or, less preferably, used to take a swig of mouthwash directly from the bottle.

In recent years, mouthwash dispensers have become prevalent in school, office, and commercial environments, and are becoming popular at home. These mouthwash dispensers are usually wall mounted and are adapted to use commonly available mouthwash bottles. However, because these mouthwash dispensers are gravity fed, the mouthwash bottles need to be inverted when mounted into the dispenser. This may lead to spillage of mouthwash inside the dispenser, which not only wastes the mouthwash, but may not be easily cleaned without disassembling the mouthwash dispenser or dismounting the mouthwash dispenser from the wall.

Accordingly, it is desirable to develop mouthwash dispensing systems that are adapted to use commercially available mouthwash bottles and that prevent or reduce spillage.

BRIEF SUMMARY

This summary is intended merely to introduce a simplified summary of some aspects of one or more embodiments of the present disclosure. Further areas of applicability of the present invention will become apparent from the detailed description provided hereinafter. This summary is not an extensive overview, nor is it intended to identify key or critical elements of the present teachings, nor to delineate the scope of the disclosure. Rather, its purpose is merely to present one or more concepts in simplified form as a prelude to the detailed description below.

The foregoing and/or other aspects and utilities embodied in the present disclosure may be achieved by providing a dispensing system, including a bottle, the bottle including a threaded neck defining an opening and configured to hold a liquid; a dispenser including a receiving orifice and a receiving protrusion; and a spring-actuated adapter, including: an adapter orifice; a valve stem including a spring and a seal, wherein the spring is configured to bias the seal to move the spring-actuated adapter to a closed position; a threaded adapter configured to couple the spring-actuated adapter to the threaded neck; and a form-fit adapter configured to couple the spring-actuated adapter to the dispenser; wherein, when the spring-actuated adapter is coupled to the dispenser, the receiving protrusion moves the spring-actuated adapter to an open position to allow the liquid to flow from the bottle through the adapter orifice and into the dispenser.

In another embodiment, in the open position, the receiving protrusion is configured to push the valve stem to move the seal away from the adapter orifice.

In another embodiment, the spring-actuated adapter further includes a rim defining the adapter orifice; and wherein the spring is disposed around an exterior wall of the valve stem, and wherein, when the spring-actuated adapter is coupled to the dispenser, an end of the exterior wall contacts a bottom surface of the rim to protect the spring from contact with the liquid flowing through the spring-actuated adapter.

In another embodiment, a height of the receiving protrusion is configured to push the valve stem a sufficient distance to displace the seal from the adapter orifice in the open position.

In another embodiment, the valve stem includes one or more outlets, and, when the spring-actuated adapter is coupled to the dispenser, the receiving protrusion pushes the valve stem a sufficient distance to fluidly connect at least a portion of the one or more outlets to an interior of the bottle.

In another embodiment, the seal is coupled to a top surface of the valve stem, and the dimensions of the spring-actuated adapter are such that the top surface of the valve stem and at least a portion of the one or more outlets move through the receiving orifice when the spring-actuated adapter is coupled to the dispenser.

In another embodiment, the threaded adapter includes a threaded channel that receives the threaded neck.

In another embodiment, the threaded neck includes a continuous thread configured to couple to a continuous thread screw cap, and the threaded channel includes a continuous thread configured to couple to the continuous thread of the threaded neck.

In another embodiment, the threaded neck includes a non-continuous thread configured to couple to a child-proof type cap, and the threaded channel includes a complementary non-continuous thread configured to couple to the non-continuous thread of the threaded neck.

In another embodiment, the liquid is an oral care product.

In another embodiment, the bottle is a mouthwash bottle and the liquid is a mouthwash.

The foregoing and/or other aspects and utilities embodied in the present disclosure may be achieved by providing a spring-actuated adapter for a liquid dispenser, including an adapter orifice; a valve stem configured to hold a spring and a seal, wherein the spring is configured to bias the spring-actuated adapter into a closed position; a threaded adapter configured to couple the spring-actuated adapter to a bottle for the liquid; and a form-fit adapter configured to couple the spring-actuated adapter to a liquid dispenser; wherein, when the spring-actuated adapter is coupled to the liquid dispenser, the spring-actuated adapter is placed in an open position.

In another embodiment, the seal is configured to seal the adapter orifice and, in the closed position, the spring biases the seal against the adapter orifice.

In another embodiment, in the open position, the receiving protrusion pushes on the valve stem and moves the seal away from the adapter orifice, which opens the adapter orifice to allow the liquid to flow from the bottle through the adapter orifice of the spring-actuated adapter and into the dispenser.

In another embodiment, the spring-actuated adapter further includes a rim defining the adapter orifice; the spring is disposed around an exterior wall of the valve stem, and, when the spring-actuated adapter is coupled to the liquid dispenser, an end of the exterior wall contacts the rim to protect the spring from contact with the liquid flowing through the spring-actuated adapter.

In another embodiment, the threaded adapter includes a threaded channel that receives a threaded neck of the bottle.

In another embodiment, the liquid is a mouthwash.

The foregoing and/or other aspects and utilities embodied in the present disclosure may be achieved by providing a mouthwash dispensing system substantially as described.

BRIEF DESCRIPTION OF THE DRAWINGS

The accompanying drawings, which are incorporated in and constitute a part of this specification, illustrate examples of embodiments of the present teachings. These and/or other aspects and advantages in the embodiments of the disclosure will become apparent and more readily appreciated from the following description of the various embodiments, taken in conjunction with the accompanying drawings of which.

Figure 1:
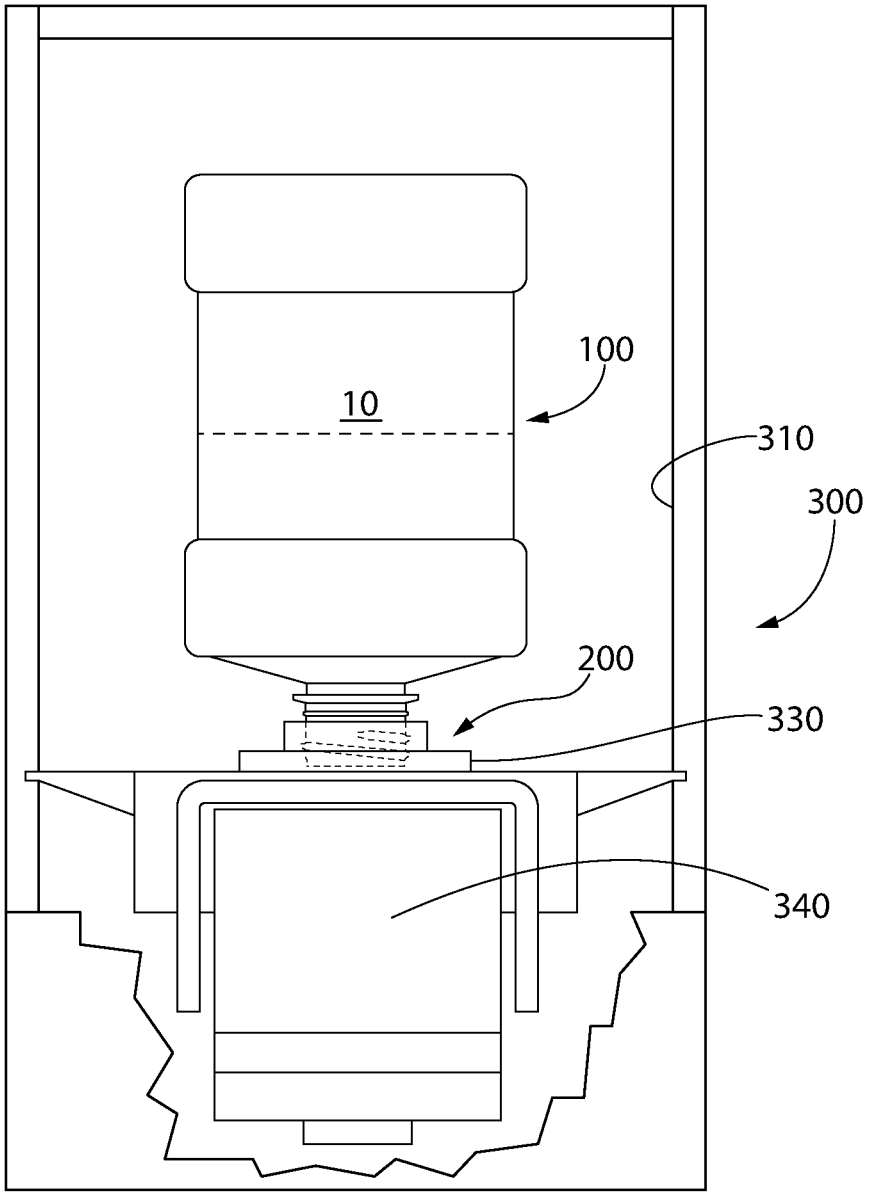
FIG. 1 illustrates a mouthwash dispensing system according to an embodiment.

These drawings/figures are intended to be explanatory and not restrictive.

DETAILED DESCRIPTION

Reference will now be made in detail to the various embodiments in the present disclosure, examples of which may be illustrated in the accompanying drawings and figures. The embodiments are described below to provide a more complete understanding of the components, processes, and apparatuses disclosed herein. Any examples given are intended to be illustrative, and not restrictive. However, it will be apparent to one of ordinary skill in the art that the invention may be practiced without these specific details. In other instances, well-known methods, procedures, and components have not been described in detail so as not to unnecessarily obscure aspects of the embodiments.

Throughout the specification and claims, the following terms take the meanings explicitly associated herein, unless the context clearly dictates otherwise. The phrases "in some embodiments" and "in an embodiment" as used herein do not necessarily refer to the same embodiment(s), though they may. Furthermore, the phrases "in another embodiment" and "in some other embodiments" as used herein do not necessarily refer to a different embodiment, although they may. As described below, various embodiments may be readily combined, without departing from the scope or spirit of the present disclosure.

As used herein, the term "or" is an inclusive operator, and is equivalent to the term "and/or," unless the context clearly dictates otherwise. The term "based on" is not exclusive and allows for being based on additional factors not described, unless the context clearly dictates otherwise. In the specification, the recitation of "at least one of A, B, and C," includes embodiments containing A, B, or C, multiple examples of A, B, or C, or combinations of A/B, A/C, B/C, A/B/B/ BB/C, AB/C, etc. In addition, throughout the specification, the meaning of "a," "an," and "the" include plural references. The meaning of "in" includes "in" and "on."

It will also be understood that, although the terms first, second, etc. may be used herein to describe various elements, these elements should not be limited by these terms. These terms are only used to distinguish one element from another. For example, a first object, component, or step could be termed a second object, component, or step, and, similarly, a second object, component, or step could be termed a first object, component, or step, without departing from the scope of the invention. The first object, component, or step, and the second object, component, or step, are both, objects, component, or steps, respectively, but they are not to be considered the same object, component, or step. It will be further understood that the terms "includes," "including," "comprises" and/or "comprising," when used in this specification, specify the presence of stated features, steps, operations, elements, and/or components, but do not preclude the presence or addition of one or more other features, steps, operations, elements, components, and/or groups thereof. Further, as used herein, the term "if" may be construed to mean "when" or "upon" or "in response to determining" or "in response to detecting," depending on the context.

When referring to any numerical range of values herein, such ranges are understood to include each and every number and/or fraction between the stated range minimum and maximum, as well as the endpoints. For example, a range of 0.5-6% would expressly include all intermediate values of, for example, 0.6%, 0.7%, and 0.9%, all the way up to and including 5.95%, 5.97%, and 5.99%, among many others. The same applies to each other numerical property and/or elemental range set forth herein, unless the context clearly dictates otherwise.

Additionally, all numerical values are "about" or "approximately" the indicated value, and take into account experimental error and variations that would be expected by a person having ordinary skill in the art. It should be appreciated that all numerical values and ranges disclosed herein are approximate values and ranges, whether "about" is used in conjunction therewith.

With regard to procedures, methods, techniques, and workflows that are in accordance with some embodiments, some operations in the procedures, methods, techniques, and workflows disclosed herein may be combined and/or the order of some operations may be changed.

FIG. 1 illustrates a mouthwash dispensing system according to an embodiment of the present disclosure. As illustrated in FIG. 1, the mouthwash dispenser system may include a mouthwash bottle 100, a spring-actuated adapter 200, and a mouthwash dispenser 300.

The mouthwash bottle 100 may be conventionally shaped to store and dispense an oral care fluid 10, such as a mouthwash, fluoride solution, teeth whitening solution, etc. The mouthwash bottle 100 may be made of FDA-approved materials for the storage of oral care fluids. For example, the mouthwash bottle 100 may be made out of polymeric plastics such as polyethylene terephthalate (PET), polyethylene, or polypropylene.

In the example shown in FIG. 1, the mouthwash bottle 100 is inverted and the neck 150 (see FIG. 2) of the mouthwash bottle 100 is inserted into the spring-actuated adapter 200, both of which are inserted into the mouthwash dispenser 300.

Figure 2:
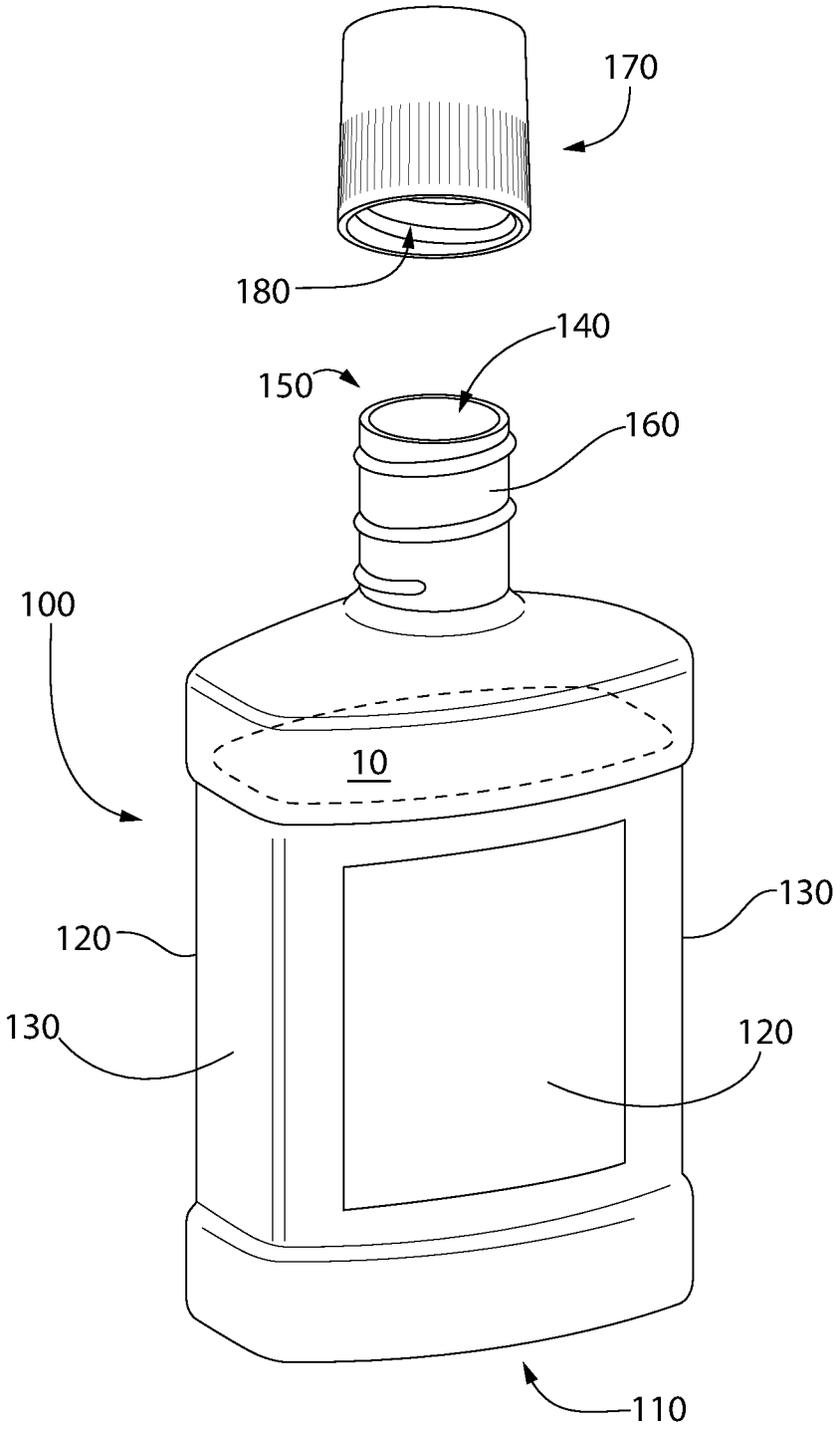
FIG. 2 illustrates a mouthwash bottle according to an embodiment.

FIG. 2 illustrates a mouthwash bottle according to an embodiment. As illustrated in FIG. 2, the mouthwash bottle 100 may include a base 110, two pairs of sidewalls 120, 130, and a neck 150. Also shown is a cap 170 for the mouthwash bottle 100.

The base 110 may be a flat base 110 designed to allow the mouthwash bottle 100 to sit stably in an upright position on a flat surface, such as a counter top.

The mouthwash bottle 100 may have a substantially rectilinear shape, and one pair of opposing sidewalls 120 may have greater length than the other pair of opposing sidewalls 130. However, the present disclosure is not limited to rectilinear shaped bottles, and the mouthwash bottle 100 may have other shapes or configurations, such as a substantially cylindrical shape, that can be accommodated by the mouthwash dispenser 300.

The neck 150 defines an opening 140 into the interior of the mouthwash bottle 100 and may include threads 160 to couple with complementary threads 180 of the cap 170.

In some embodiments, the cap 170 may be configured as a conventional screw cap, and the threads 160 and complementary threads 180 may be continuous screw threads. In other embodiments, the cap 170 may be a child-proof cap, and the threads 160 and complementary threads 180 may be non-continuous threads. However, the present disclosure is not limited to continuous or non-continuous threads only, and the mouthwash bottle 100 may use other types of threads or coupling mechanisms to attach the cap 170. The neck-to-cap coupling mechanism, whether threads or another mechanism, may also be used to couple the mouthwash bottle 100 to the spring-actuated adapter 200.

The spring-actuated adapter 200 couples to the neck 150 of the mouthwash bottle 100 and allows the mouthwash bottle 100 to be mounted on the mouthwash dispenser 300 while minimizing spillage. The spring-actuated adapter 200 may be made of FDA-approved materials for the storage of oral care fluids. For example, the spring-actuated adapter 200 may be made out of polymeric plastics such as high density polypropylene or high density polyethylene.

Figure 3:
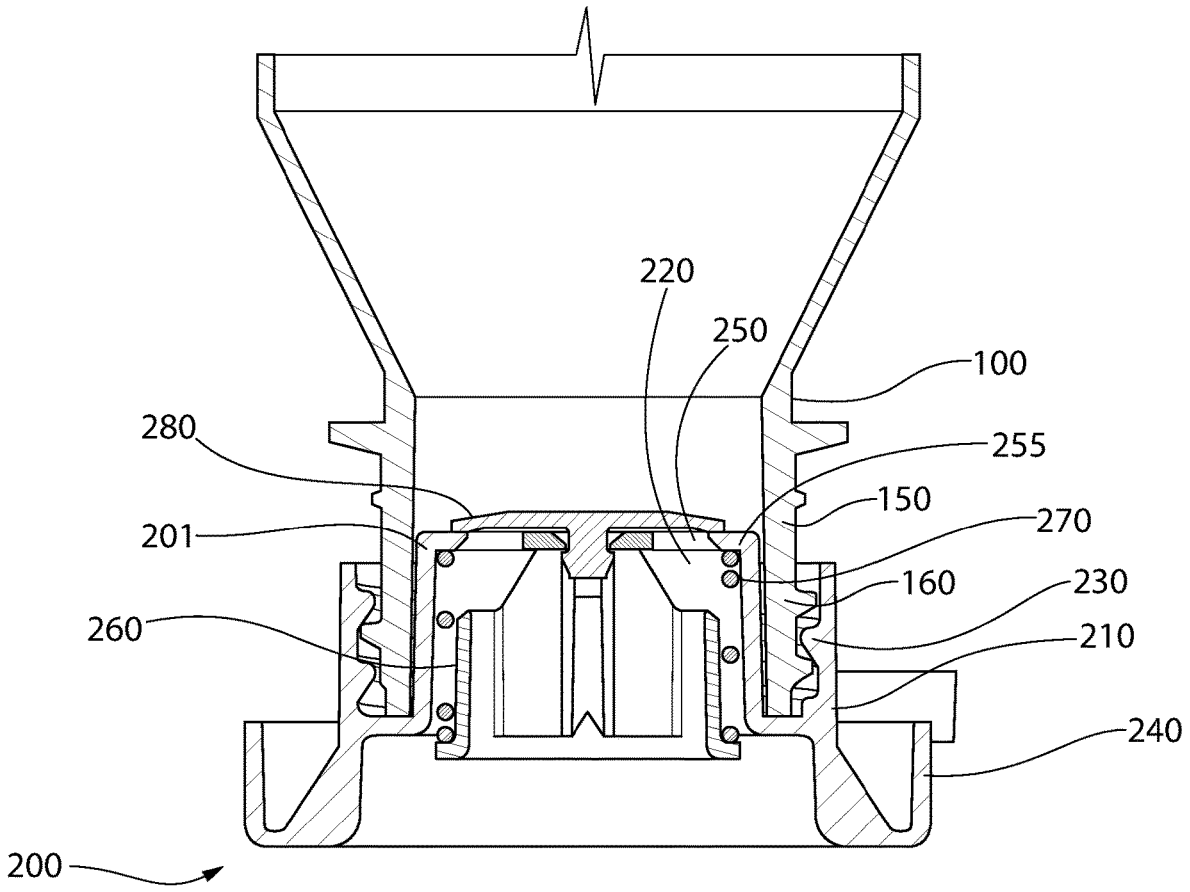
FIG. 3 illustrates a spring-actuated adapter according to an embodiment.

FIG. 3 illustrates a spring-actuated adapter 200 according to an embodiment of the present disclosure. As illustrated in FIG. 3, the spring-actuated adapter 200 may include an adapter body 210, a valve-stem 260, a spring 270, and a seal 280.

Figure 7:
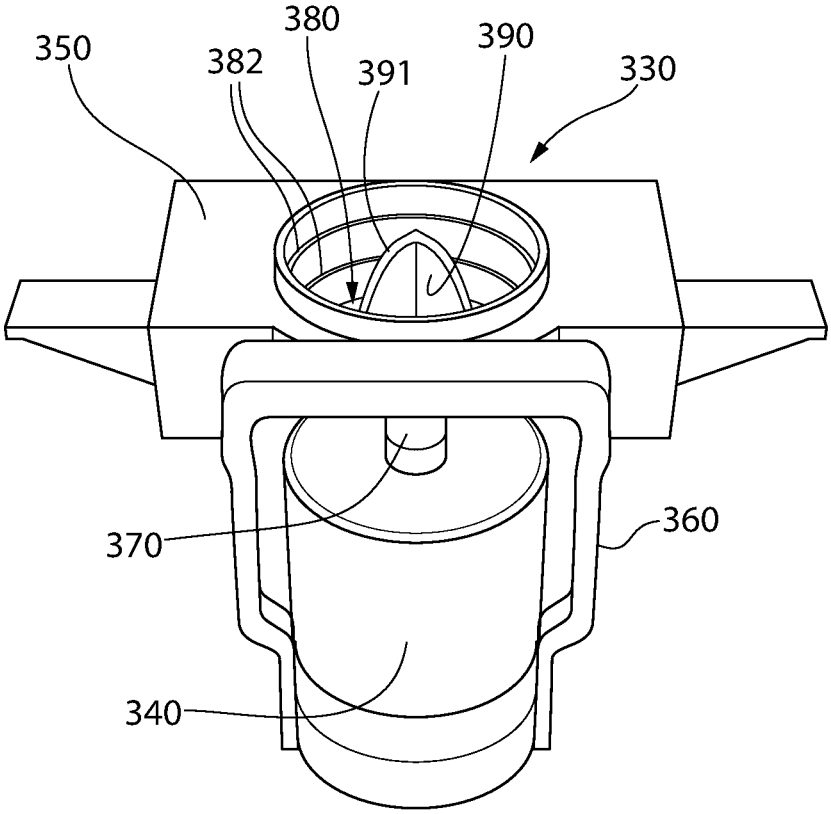
FIG. 7 illustrates a mouthwash dispenser according to an embodiment.

The adapter body 210 may have a generally cylindrical shape to correspond to the shape of the neck 150 of the mouthwash bottle 100 and/or the bottle receiver 330 of the mouthwash dispenser 300 (see FIG. 7).

The adapter body 210 may define a valve cavity 220, a threaded adapter 230, a friction-fit adapter 240, and an adapter orifice 250.

The threaded adapter 230 is configured to attach to, connect with, or otherwise receive the neck 150 of the mouthwash bottle 100. In the particular embodiment shown, the threaded adapter 230 defines a channel profile that includes interior threads that are complementary to the threads 160 of the neck 150. For example, if the mouthwash bottle 100 uses a continuously threaded screw cap, the threaded adapter 230 is configured to receive continuous threads. Similarly, if the mouthwash bottle 100 uses a non-continuous thread child-proof cap, the threaded adapter 230 is configured to receive non-continuous threads. In one embodiment, the threaded adapter 230 defines a channel that receives the neck 150 of the mouthwash bottle 100 and the adapter body 210 is configured to screw onto the mouthwash bottle 100.

The friction-fit adapter 240 is adapted to couple the spring-actuated adapter 200 to the mouthwash dispenser 300, as described further below. The friction-fit adapter 240 may be shaped as a circular projection that has a channel. In some embodiments, the friction-fit adapter 240 extends outwardly from an interior wall 201 of the adapter body 210 and is larger than the threaded adapter 230. For example, the friction-fit adapter 240 may have a larger cross-section than the threaded adapter 230 or may have a larger radius (e.g., be radially larger) than the threaded adapter 230.

The valve cavity 220 may be a cylindrical cavity defined by the interior wall 201 of the adapter body 210. The valve cavity 220 is configured to receive the valve-stem 260 and the spring 270 and defines an adapter orifice 250 which may be selectively unsealed (opened) and sealed (closed) by the seal 280. In some embodiments, a rim 255 extends inwardly from a top of the interior wall 201 to define the adapter orifice 250. In some such embodiments, the rim 255 defines a surface against which the spring 270 can rest. In certain embodiments, the rim 255 also defines a surface against which the seal 280, installed on the valve stem 260, can rest.

Figure 4:
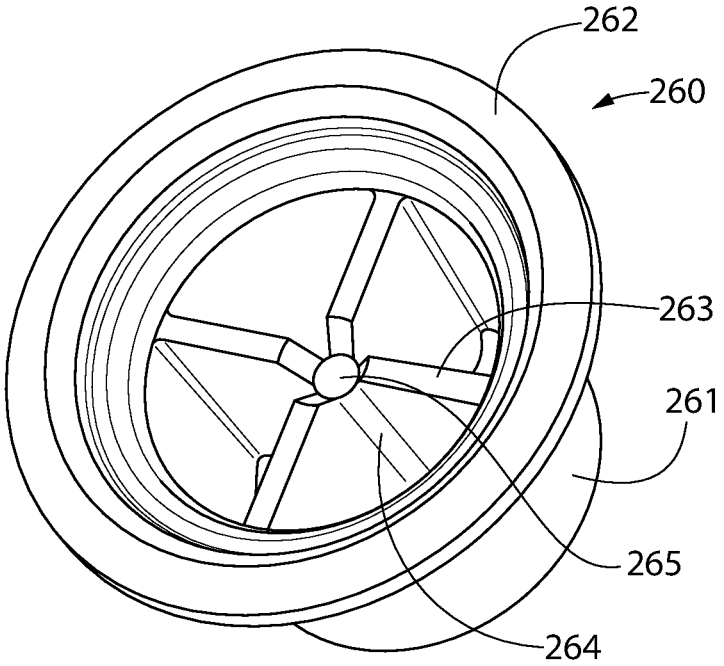
FIG. 4 illustrates a stem-valve of the spring-actuated adapter of FIG. 3.
Figure 5:
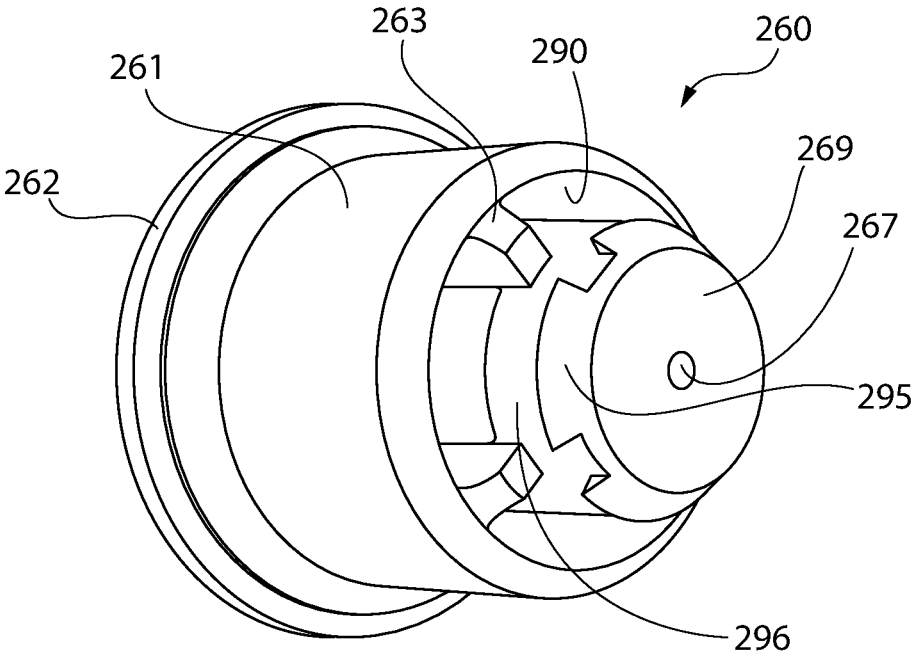
FIG. 5 illustrates the stem-valve of FIG. 4.

FIGS. 4-5 illustrate a valve stem according to embodiments of the present disclosure. As illustrated in FIGS. 3-5, the valve stem 260 may be generally cylindrical in shape. The valve stem 260 may include an exterior wall 261, a spring rim 262, one or more structural ribs 263, a central axis member 264, and a top surface 269.

The exterior wall 261 may be substantially cylindrical in shape. One or more structural ribs 263 may extend from the exterior wall 261 inwards to the central axis member 264. In some embodiments, the central axis member 264 may extend from a contact point 265 to a seal stop 266 (see FIG. 8). In other embodiments, the central axis member 264 may extend from the contact point 264 to the top surface 269 of the valve stem 260.

In some embodiments, the exterior wall 261 does not extend all the way to the top surface 269. Instead, one or more outlets 290 are defined, at least partially, by one or more gaps between the end of the exterior wall 261 and the top surface 269. For example as shown in FIG. 5, the exterior wall 261 may have a diameter larger than the top surface 269, defining a horizontal gap between the exterior wall 261 and the top surface 269. In addition, the end of the exterior wall 261 may be lower than the top surface 269, defining a vertical gap between the exterior wall 261 and the top surface 269.

The one or more outlets 290 may also be defined, at least partially, by the one or more structural ribs 263 extending from the end of the exterior wall 261 inwards to the top surface 269.

In some embodiments, the top surface 269 includes a seal lock orifice 267. In other embodiments, the top surface 269 includes top projections 295 and/or a top wall 296. The top projections 295 may hold the seal 280 (not shown in FIG. 5) in place.

As shown in FIG. 4, in some embodiments, the one or more structural ribs 263 may extend inward and upwardly from the exterior wall 261 to the central axis member 264 to define a contact point 265 that is concave relative to the ends of the structural ribs 263 or a contact point 265 that is offset from the end of the exterior wall 261.

The spring rim 262 may extend outwardly from the end of the exterior wall 261 and define a shelf-like surface for the spring 270 (not shown in FIGS. 4 and 5).

In some embodiments, the spring 270 is a helical or coil spring configured to fit around the exterior wall 261 of the valve stem 260 and to rest against or contact the spring rim 262. The spring 270 may be made of a metal, such as stainless steel. In some embodiments, the spring 270 is a coated metal spring. For example, in certain embodiments, the spring 270 comprises 316 stainless steel spring to prevent oxidation and to reduce potential contamination from corrosion of the spring 270.

Referring again to FIG. 3, the spring-actuated adapter 200 may include a seal 280. The seal 280 may be made of a flexible elastomer or plastic, such as polyethylene or polypropylene. In some embodiments, the seal 280 comprises polyethylene.

Figure 8:
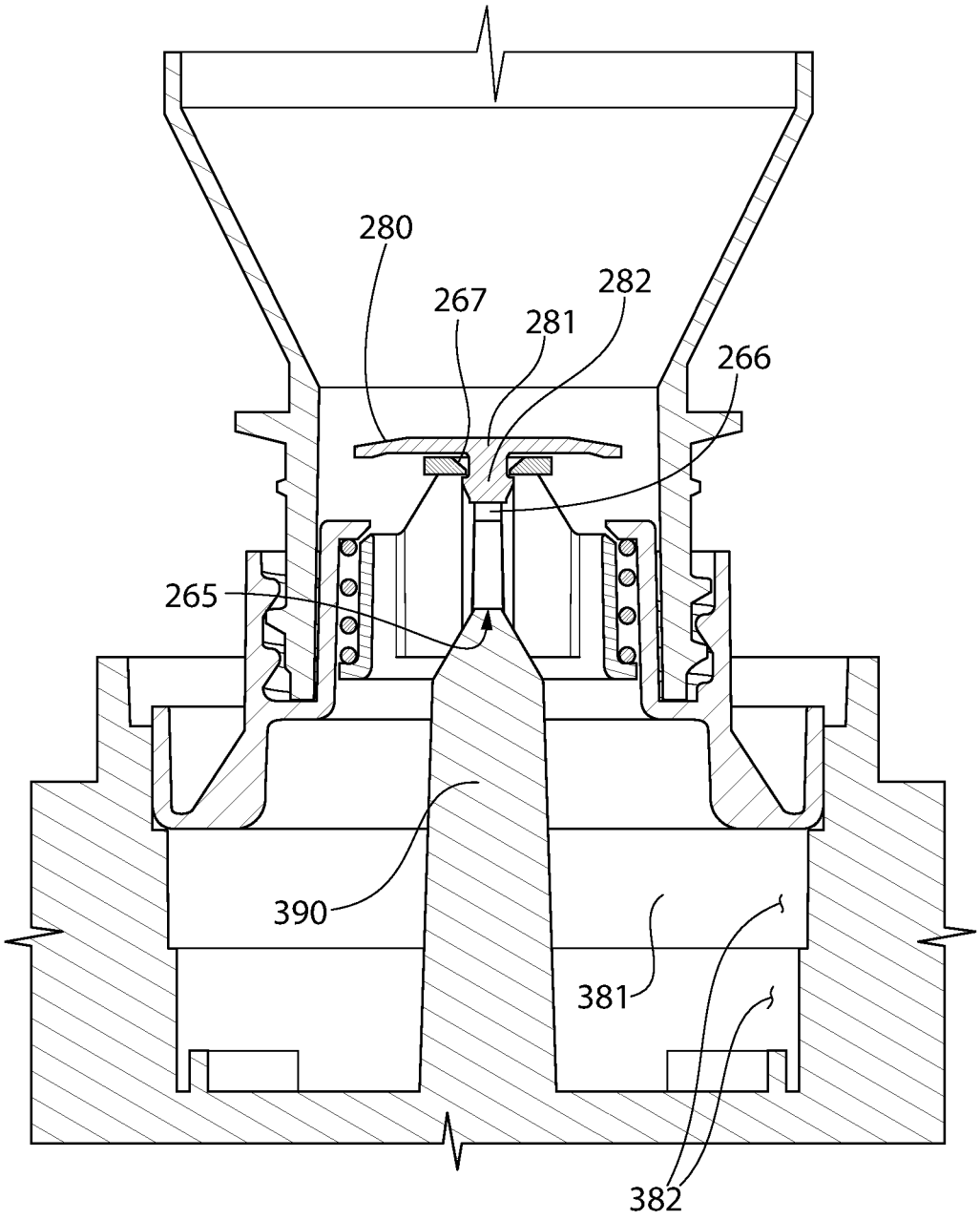
FIG. 8 illustrates a spring-actuated adapter according to an embodiment.
Figure 9:
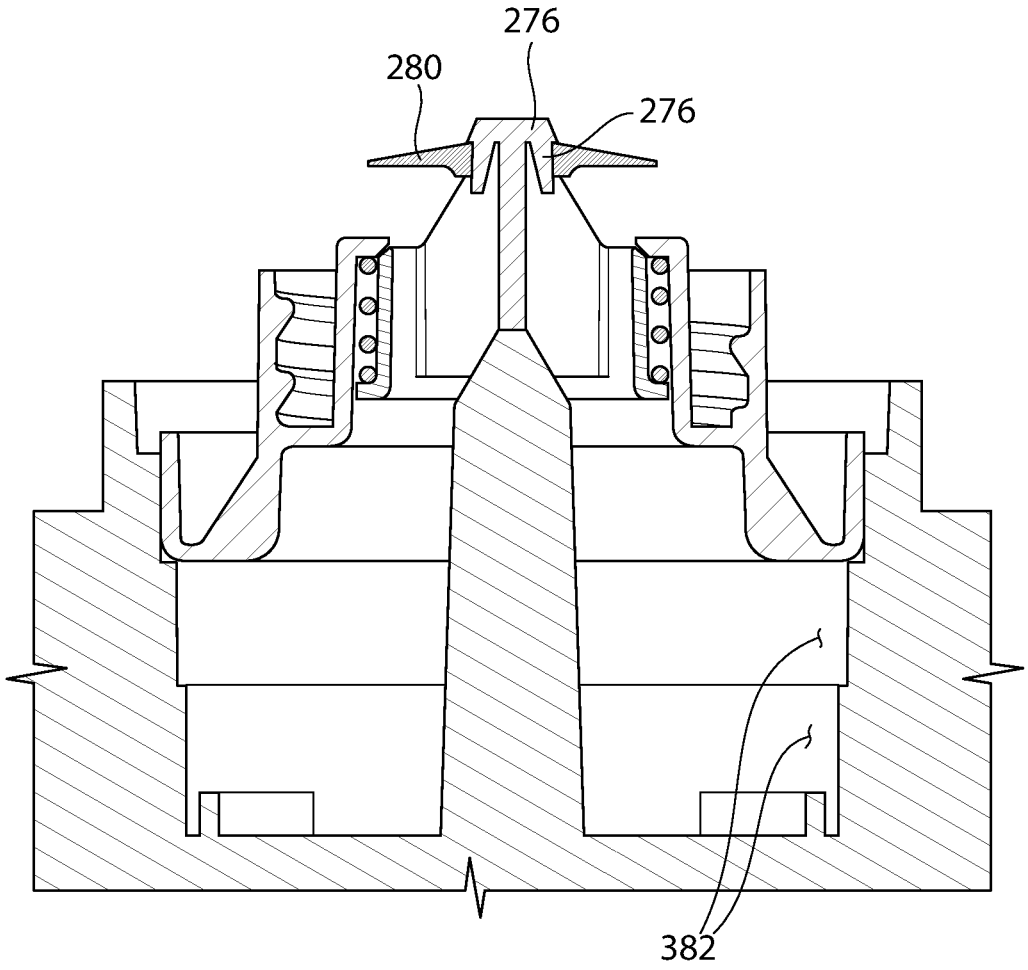
FIG. 9 illustrates a spring-actuated adapter according to an embodiment.

Referring now to FIGS. 3 and 8-9, which show various examples of a spring-actuated adapter, in some embodiments, the seal 280 includes a seal body 281 and a seal lock 282. The seal body 281 may be generally circular in shape to correspond to or cover the adapter orifice 250. For example, the seal body 281 may be shaped like a disk (FIGS. 3, 8) or a toroid (FIG. 9) with an outside diameter larger than the diameter of the adapter orifice 250. The seal body 281 may also include a seal lock 282, as shown in FIGS. 3 & 8. For example, the seal lock 282 may be or include a barbed shaft extending from a central point of the disk-shaped seal body 281.

As illustrated in FIGS. 3 & 8, the barbed-shaft seal lock 282 is configured to be inserted into a cavity defined by the seal lock orifice 267 and the seal stop 266, and may be used to couple the seal 280 to the valve stem 260 of the spring-actuated adapter 200.

While FIGS. 3 & 8 illustrate a disk-shaped seal 280, the present disclosure is not limited thereto, and other seal shapes may be used that can couple to the valve stem 260 to seal the adapter orifice 250. For example, as illustrated in FIG. 9, the seal 280 may comprise a toroid or flat, washer-shaped, seal body 281 which is fitted around the top surface 269. The top surface 269 may include one or more top projections 295 extending outwardly from the top surface 269, and a top wall 296 extending downwardly from the top surface 269. In one embodiment, the washer-shaped seal 280 is disposed to encircle the top wall 296 below the top projections 295, and the top projections 295 are configured to keep the washer-shaped seal 280 in place.

In some embodiments, the surface area or diameter of the top surface 269 is smaller than the open area or diameter defined by the adapter orifice 250, and the top surface 269 is configured to fit through the adapter orifice 250. In some such embodiments, the diameter of the exterior wall 261 is larger than the diameter of the open area defined by the adapter orifice 250, such that the exterior wall 261 does not fit through the adapter orifice 250, as shown in FIG. 3. For example, the exterior wall 261 may be configured such that the end of the exterior wall 261 contacts and is stopped by the rim 255 when the valve stem 260 is pushed through the adapter orifice 250, as shown in the embodiments of FIGS. 8 and 9. In some such embodiments, the valve stem 220 is configured to allow the top surface 269 and at least a portion of the one or more outlets 290 through the adapter orifice 250 before the end of the exterior wall 261 hits or is stopped by the rim 255.

The spring-actuated adapter 200 may be assembled as follows: first, the spring 270 is placed around the exterior wall 261 such that one end of the spring 270 rests against the spring rim 262 of the valve stem 260. The valve stem 260 with the placed spring 270 is then inserted into the valve cavity 220 of the adapter body 210, which brings the other end of the spring 270 into contact with the rim 255. The valve stem 260 is then pushed upwards, compressing the spring 270 between the spring rim 262 and the rim 255 and pushing the top surface 269 of the valve stem 260 through the adapter orifice 250. In this position, the seal 280 is then coupled to the top surface 269. For example, the seal barb 282 of a disk-shaped seal 280 may be inserted through the seal lock orifice 267 to couple the disk-shaped seal 280 to the valve stem 260. For another example, a washer-shaped seal 280 may be placed around the top wall 296 and below the top projections 295 to couple the washer-shaped seal 280 to the valve stem 260. Once the seal 280 is coupled to the top surface 269, the valve stem is released, and the spring 270 pushes the valve-stem down until the seal 280 contacts an upper surface of the rim 255 to seal the adapter orifice 250. As illustrated in FIG. 3, the spring 270 biases the valve stem 260 downwards into a closed position such that the seal 280 covers the adapter orifice 250.

Because the spring-actuated adapter 200 biases the stem-valve 260 downwards into the closed position, when the spring-actuated adapter 200 is mounted on the mouthwash bottle 100 the seal covers the adapter orifice 250 and mouthwash 10 is prevented from flowing out of the mouthwash bottle 100 through the spring-actuated adapter 200. Accordingly, the spring-actuated adapter 200 seals the mouthwash bottle 100, and the mouthwash bottle 100 can be inverted for a spill-free installation into the mouthwash dispenser 300.

Figure 6:
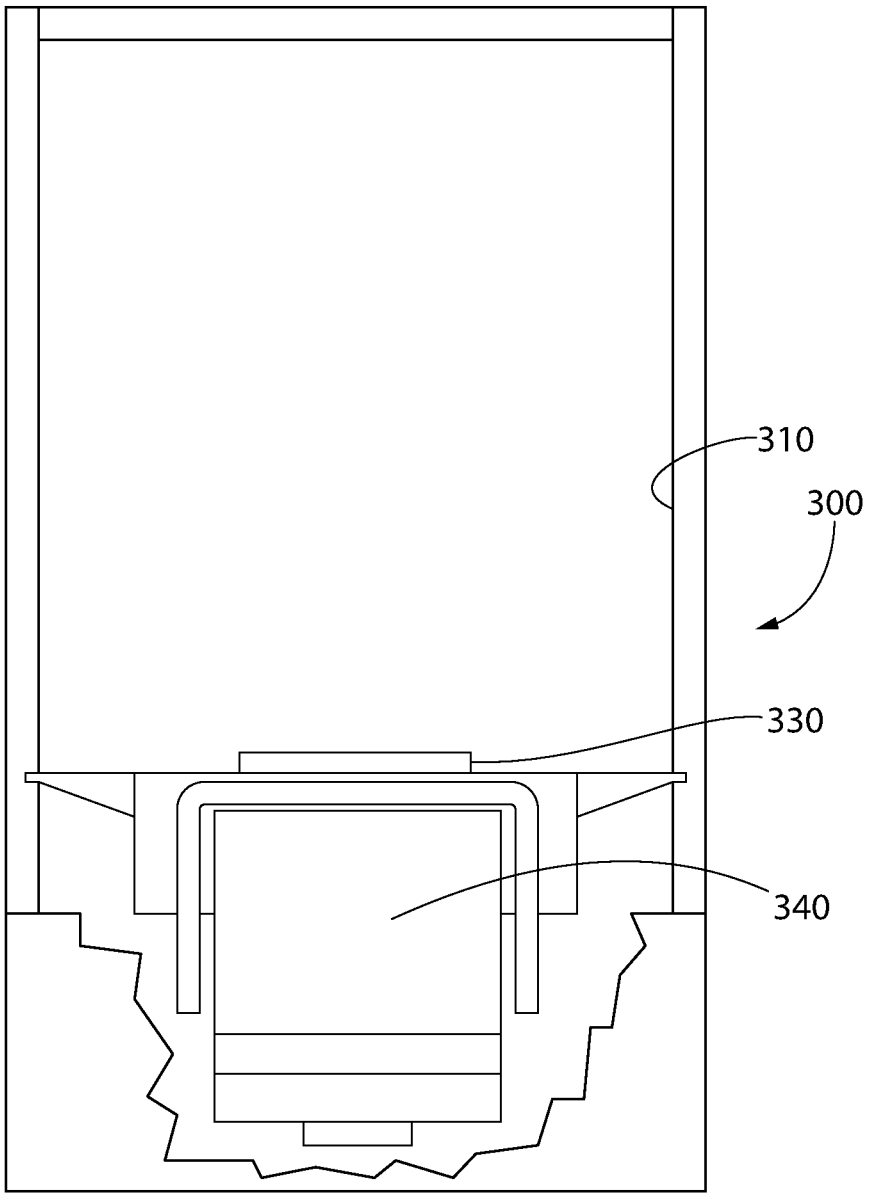
FIG. 6 illustrates a mouthwash dispenser according to an embodiment.

FIGS. 6-7 illustrate a mouthwash dispenser according to embodiments of the present disclosure. As illustrated in FIGS. 6-7, a mouthwash dispenser 300 may include a body 310, a bottle receiver 330, and a dispenser 340. The mouthwash dispenser 300 may also include a cover (not shown), which covers an interior of the mouthwash dispenser 300 and the mouthwash bottle 100 when it is disposed within the mouthwash dispenser 300.

The bottle receiver 330 and the dispenser 340 may be disposed within the body 310, and the cover (not illustrated) may be removable to allow placement of the mouthwash bottle 100 inside the mouthwash dispenser 300. As illustrated in FIGS. 1 and 3, the mouthwash bottle 100 is coupled to the spring-actuated adapter 200 before placing the mouthwash bottle 100 into the mouthwash dispenser 300.

The bottle receiver 330 may include a reservoir 350 to hold a predetermined amount of mouthwash 10, which is dispensed or provided by the dispenser 340.

The dispenser 340 may include a lever 360 and a lever-actuated dispensing mechanism 370 to dispense the mouthwash from the reservoir 350, for example, into a cup held by a user. In some embodiments, the dispenser 340 dispenses a metered amount of mouthwash 10 when the lever 360 is actuated by a user. In other embodiments, the dispenser 340 dispenses a continuous amount of mouthwash 10 while the lever 360 is actuated until the lever 360 is released. While the present disclosure describes a lever-actuated dispensing mechanism, the present disclosure is not limited thereto, and other dispensing mechanisms may be use to dispense mouthwash 10 from the dispenser 340. For example, the dispenser 340 may utilize spring-actuated, electronic, or electro-mechanical dispensing mechanism, among others.

As described further below, the bottle receiver 330 may include a receiving orifice 380 and a receiving protrusion 390 to receive the spring-actuated adapter 200.

FIG. 3 illustrates a spring-actuated adapter 200 coupled to a mouthwash bottle 100. FIG. 8 illustrates the spring-actuated adapter 200 coupled to the mouthwash bottle 100 of FIG. 3, while the spring-actuated adapter 200 is also coupled to the mouthwash dispenser 300.

As illustrated in FIG. 8, the receiving orifice 380 may have a size and shape corresponding to the friction-fit adapter 240 of the spring-actuated adapter 200. For example, as illustrated in FIG. 8, the ring-shaped friction-fit adapter 240 is sized to fit within the circular receiving orifice 380. In some embodiments, the dimensions of the friction-fit adapter 240 are configured to form a tightening friction-fit coupling of the friction-fit adapter 240 into the receiving orifice 380. For example, the outer diameter (OD) of the friction-fit adapter 240 may be slightly larger (in thousands of an inch) than the inner diameter (ID) of the receiving orifice 380. In certain embodiments, an interior surface 381 of the receiving orifice 380 may include surface features or layers to improve the friction-fit of the friction-fit adapter 240. As illustrated in FIGS. 7-8, the interior surface 381 may include constriction bands 382 to reduce a cross section of the receiving orifice 380 in a downward direction.

The receiving protrusion 390 may extend upwards from a central point of the receiving orifice 380. As illustrated in FIGS. 7-8, the receiving protrusion 390 may comprise a pointed shaft or member that includes intersecting ribs 391. While the receiving protrusion 390 is illustrated as a pointed shaft member 390 in FIG. 7, the present disclosure is not limited thereto, and other shapes and configurations for the receiving protrusion 390 are envisioned that are configured to contact the contact point 265. For example, FIGS. 8-9 illustrate a more frusto-conical receiving protrusion 390.

The receiving protrusion 390 is configured to contact the contact point 265 of the valve stem 260 when the spring-actuated adapter 200 is inserted into the receiving orifice 380.

As illustrated in FIG. 8, a height of the receiving protrusion 390 may be configured to push or otherwise displace the valve stem 260 upwards a sufficient distance to push the top surface 269 of the valve-stem 220 through the adapter orifice 250, lift or displace the seal 280 away from the adapter orifice 250, and expose at least part of the one or more outlets 290 to the interior of the mouthwash bottle 100. As illustrated in FIG. 8, when the spring-actuated adapter 200 is coupled to the bottle receiver 330, the receiving protrusion 390 pushes or displaces the valve-stem 220 in a direction (upwards) that puts the valve-stem 220 into the open position. Mouthwash 10 can then flow from inside the mouthwash bottle 100 through the one or more outlets 290 and the adapter orifice 250 and into the receiving orifice 380 of the mouthwash dispenser 300.

As illustrated in FIG. 8, when the spring-actuated adapter 200 is in the open position, the top surface of the exterior wall 261 may be in contact with, or nearly in contact with, a bottom surface of the rim 255, which stops or minimizes the flow of mouthwash 10 into the annular space occupied by the spring 270 and reduces the spring's 270 contact with the mouthwash 10 flowing through the spring-actuated adapter 200. This feature may help protect the spring 270 from any corrosive or deleterious effects the mouthwash 10 may have on the material of the spring 270 and/or help maintain the spring 270 free of buildup or material from the mouthwash 10 that may degrade the function of the spring 270 and therefore extend an usable life of the spring-actuated adapter 200.

The present disclosure has been described with reference to exemplary embodiments. Although a few embodiments have been shown and described, it will be appreciated by those skilled in the art that changes may be made in these embodiments without departing from the principles and spirit of preceding detailed description. For example, although the embodiments have been described in the context of a mouthwash dispenser, a mouthwash bottle, and mouthwash, the present disclosure may be applied to dispensers and bottle for many other types of liquids, such as oral care liquids, cologne, hand soap, disinfectant liquid, hair products, beverages, etc. It is intended that the present disclosure be construed as including all such modifications and alterations insofar as they come within the scope of the appended claims or the equivalents thereof.

What is claimed is:

1. A dispensing system, comprising:

a bottle, the bottle comprising a threaded neck defining an opening and configured to hold a liquid;

a dispenser comprising a receiving orifice and a receiving protrusion; and a spring-actuated adapter, comprising:

an adapter orifice;

a valve stem configured to hold a spring and a seal, wherein the spring is configured to bias the seal to move the spring-actuated adapter to a closed position;

a threaded adapter configured to couple the spring-actuated adapter to the threaded neck; and a form-fit adapter configured to couple the spring-actuated adapter to the dispenser;

wherein, when the spring-actuated adapter is coupled to the dispenser, the receiving protrusion moves the spring-actuated adapter to an open position to allow the liquid to flow from the bottle through the adapter orifice and into the dispenser;

wherein the spring-actuated adapter further comprises a rim defining the adapter orifice; and wherein the spring is disposed around an exterior wall of the valve stem, and wherein, when the spring-actuated adapter is coupled to the dispenser, an end of the exterior wall contacts a bottom surface of the rim to protect the spring from contact with the liquid flowing through the spring-actuated adapter.

2. The dispensing system of claim 1, wherein, in the open position, the receiving protrusion is configured to push the valve stem to move the seal away from the adapter orifice.

3. The dispensing system of claim 2, wherein the receiving protrusion is configured to push the valve stem a sufficient distance to displace the seal from the adapter orifice in the open position.

4. The dispensing system of claim 3, wherein the valve stem comprises one or more outlets, and wherein, when the spring-actuated adapter is coupled to the dispenser, the receiving protrusion pushes the valve stem a sufficient distance to fluidly connect at least a portion of the one or more outlets to an interior of the bottle.

5. The dispensing system of claim 4, wherein the seal is coupled to a top surface of the valve stem, and wherein the top surface of the valve stem and at least a portion of the one or more outlets are fluidly connected to the receiving orifice when the spring-actuated adapter is coupled to the dispenser.

6. The dispensing system of claim 1, wherein the threaded adapter comprises a threaded channel that receives the threaded neck.

7. The dispensing system of claim 6, wherein the threaded neck comprises a continuous thread configured to couple to a continuous thread screw cap, and wherein the threaded channel comprises a continuous thread configured to couple to the continuous thread of the threaded neck.

8. The dispensing system of claim 6, wherein the threaded neck comprises a non-continuous thread configured to couple to a child-proof type cap, and wherein the threaded channel comprises a complementary non-continuous thread configured to couple to the non-continuous thread of the threaded neck.

9. The dispensing system of claim 1, wherein the liquid is an oral care product.

10. The dispensing system of claim 9, wherein the bottle is a mouthwash bottle and the liquid is a mouthwash.

11. A spring-actuated adapter for a liquid dispenser, comprising:

an adapter orifice;

a valve stem configured to hold a spring and a seal, wherein the spring is configured to bias the spring-actuated adapter into a closed position;

a threaded adapter configured to couple the spring-actuated adapter to a bottle; and a form-fit adapter configured to couple the spring-actuated adapter to a liquid dispenser;

wherein, when the spring-actuated adapter is coupled to the liquid dispenser, the spring-actuated adapter is placed in an open position;

wherein the spring-actuated adapter further comprises a rim defining the adapter orifice;

wherein the spring is disposed around an exterior wall of the valve stem, and wherein, when the spring-actuated adapter is coupled to the liquid dispenser, an end of the exterior wall contacts the rim to protect the spring from contact with liquid flowing through the spring-actuated adapter.

12. The spring-actuated adapter of claim 11, wherein the seal is configured to seal the adapter orifice and wherein, in the closed position, the spring biases the seal against the adapter orifice.

13. The spring-actuated adapter of claim 11, wherein, in the open position, a receiving protrusion of the dispenser pushes on the valve stem and moves the seal away from the adapter orifice, which opens the adapter orifice to allow the liquid to flow from the bottle through the adapter orifice of the spring-actuated adapter and into the dispenser.

14. The spring-actuated adapter of claim 11, wherein the threaded adapter comprises a threaded channel that receives a threaded neck of the bottle.

15. The spring-actuated adapter of claim 11, wherein the liquid is a mouthwash.

* * * * *